US008062076B2

(12) United States Patent
Henke et al.

(10) Patent No.: US 8,062,076 B2
(45) Date of Patent: Nov. 22, 2011

(54) TERMINAL BLOCK HAVING A CONNECTOR

(75) Inventors: Ralf Henke, Bruehl (DE); Sven Wehrmann, Hilden (DE)

(73) Assignee: ABB AG, Mannheim (DE)

( * ) Notice: Subject to any disclaimer, the term of this patent is extended or adjusted under 35 U.S.C. 154(b) by 33 days.

(21) Appl. No.: 12/765,439

(22) Filed: Apr. 22, 2010

(65) Prior Publication Data

US 2010/0203773 A1 Aug. 12, 2010

Related U.S. Application Data

(63) Continuation of application No. PCT/EP2008/008492, filed on Oct. 8, 2008.

(30) Foreign Application Priority Data

Oct. 23, 2007 (DE) ..... 20 2007 014 863 U
Oct. 8, 2008 (DE) ..... 20 2008 013 232 U

(51) Int. Cl.
*H01R 9/22* (2006.01)

(52) U.S. Cl. ..... 439/709; 439/532

(58) Field of Classification Search ..... 439/94, 439/532, 709–712, 715–718, 835
See application file for complete search history.

(56) References Cited

U.S. PATENT DOCUMENTS 7,753,739 B2 * 7/2010 Bentler et al. ..... 439/709
7,901,254 B2 * 3/2011 Dennes ..... 439/709
7,942,706 B1 * 5/2011 McSweyn et al. ..... 439/709

FOREIGN PATENT DOCUMENTS

DE 10 2004 040 859 A1 3/2006
EP 0 678 934 A1 10/1995

OTHER PUBLICATIONS

International Preliminary Report on Patentability (Form PCT/IB/373) and the Written Opinion of the International Searching Authority (Form PCT/ISA/237) issued in corresponding International Application No. PCT/EP2008/008492 dated Apr. 27, 2010 and an English Translation dated May 11, 2010.
International Search Report for PCT/EP2008/008492 completed Mar. 18, 2009.

* cited by examiner

*Primary Examiner* — Khiem Nguyen
(74) *Attorney, Agent, or Firm* — Buchanan Ingersoll & Rooney PC

(57) ABSTRACT

A terminal block is disclosed which includes at least one or more connectors for electrical conductors or plugs and a plurality of busbars connecting the conductor or plug connections to one another in an electrically conductive fashion. A freely configurable, pluggable transverse connector can be provided for the electrically conductive connection of at least two or more of the busbars disposed in various planes. The connector being designed as a connector pin having conductive and non-conductive sections in the axial direction.

3 Claims, 4 Drawing Sheets

TERMINAL BLOCK HAVING A CONNECTOR

This application claims priority as a continuation application under 35 U.S.C. §120 to PCT/EP2008/008492, which was filed as an International Application on Oct. 8, 2008 designating the U.S., and which claims priority to German Application 20 2007 014 863.1 filed in Germany on Oct. 23, 2007 and German Application 20 2008 013 232.0 filed in Germany on Oct. 8, 2008. The entire contents of these applications are hereby incorporated by reference in their entireties.

FIELD

The disclosure relates to a terminal block.

BACKGROUND INFORMATION

Terminal blocks are known in various forms.

By plugging connectors or introducing them into plug-in slots that are provided for them, it is possible to connect busbars of two or more terminal blocks conductively to one another in an arrangement direction, in order to provide cross-distribution of one or more potentials in the arrangement direction.

In this case, it is known for the cross-connectors to be provided with plugs which can be disconnected at weak points. As a result it is possible to conductively connect specific terminal blocks arranged in a row to one another.

SUMMARY

A terminal block is disclosed, comprising: at least one connection for electrical conductors or plugs; a plurality of busbars, which conductively connect the conductor connections or plug connections and are arranged on a plurality of different levels; and a configurable, plug-in cross-connector for conductive connection of at least two of the busbars, which are arranged on different levels, the cross-connector being a connector pin with conductive and non-conductive sections in an axial direction.

BRIEF DESCRIPTION OF THE DRAWINGS

The disclosure will be described in more detail in the following text, using exemplary embodiments and with reference to the drawings, in which.

DETAILED DESCRIPTION

Exemplary terminal block arrangements disclosed herein can make it possible to effectively connect potentials to one another in a simple manner, for distribution purposes, even within each terminal block. Such arrangements can considerably increase and extend the options for potential distribution within the terminal' block arrangement, in a simple manner.

For the purposes of this application, the expression cross-distribution refers, on one hand, to a cross-distribution in an arrangement direction over a plurality of terminal blocks, and on another hand to distribution within one terminal block, that is to say, for example, also "vertical distribution" in the terminal block. At least one of the connectors can therefore be, for example, in the form of a cross-connector, and at least one of the connectors can be, for example, in the form of a vertical connector.

Figure 1A:
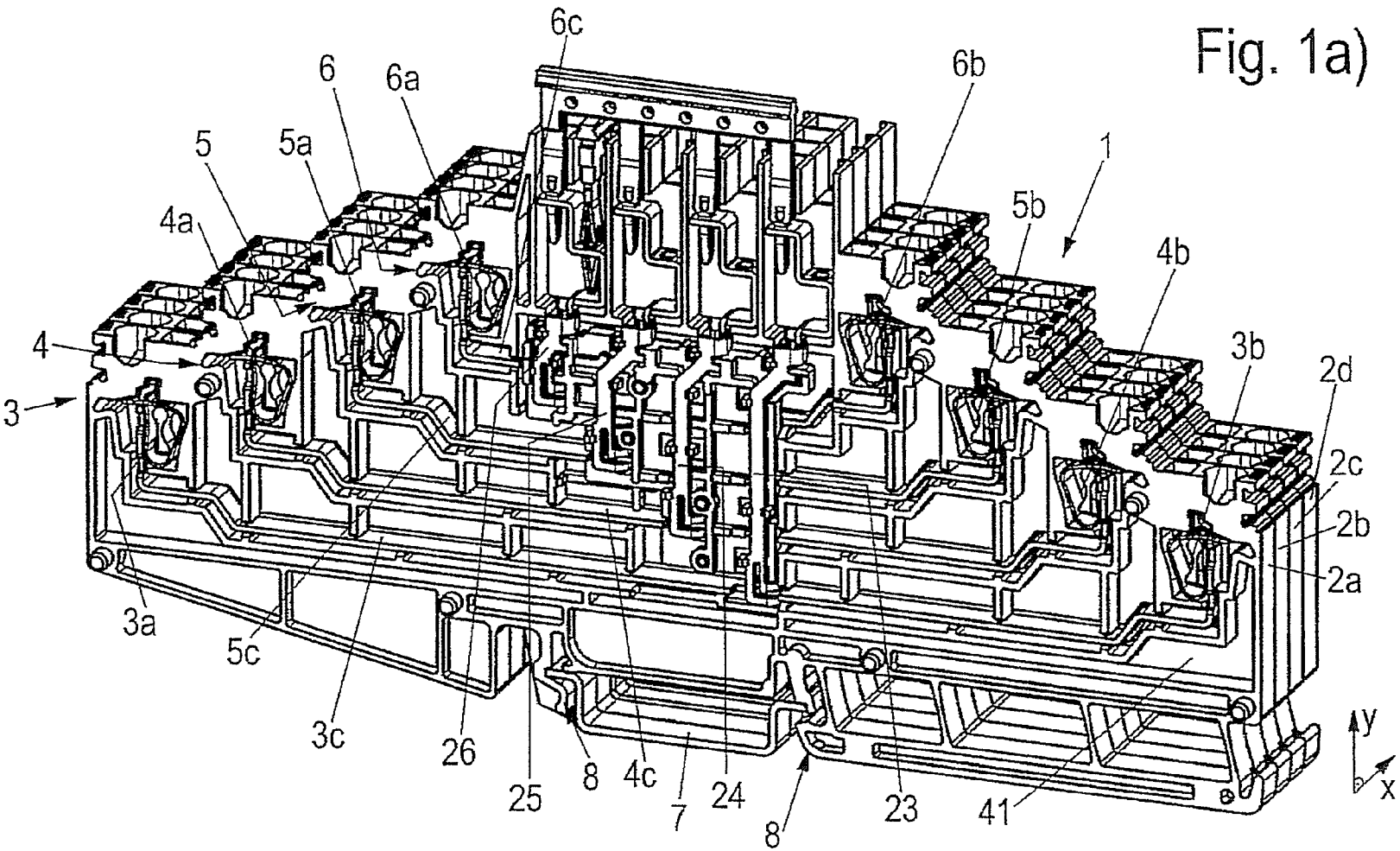
FIG. 1*a* shows a perspective view of a first exemplary terminal block arrangement with two connectors in the contacted state.
Figure 1B:
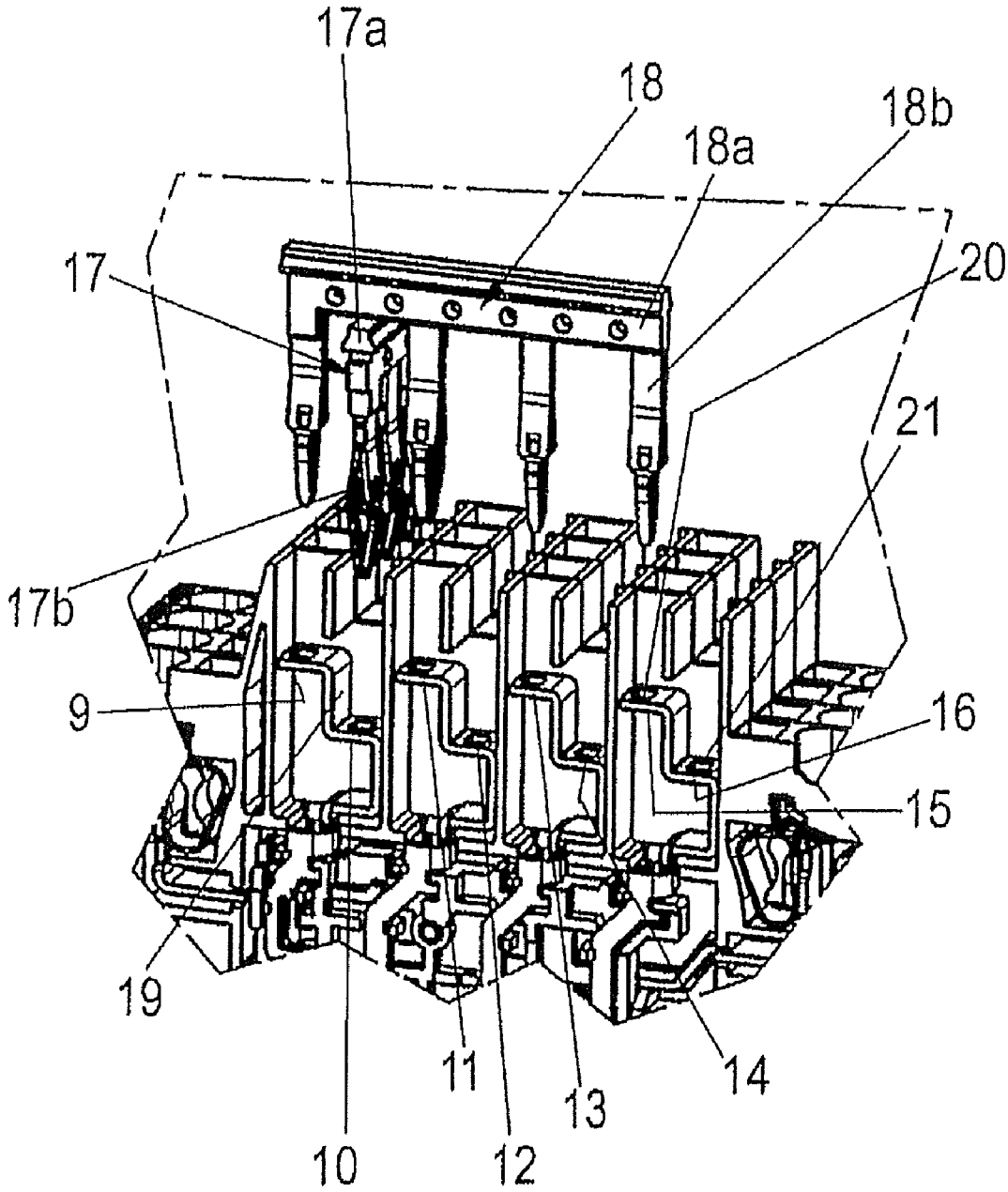
FIG. 1*b* shows a detail from FIG. 1*a*, with the connectors in a not-yet mated or contacted state.

FIG. 1 shows an exemplary terminal block arrangement 1 including terminal blocks 2*a*, 2*b*, 2*c*, . . . which can be arranged in a row and each have an insulating body 31 and at least one or more connections 3*a*, 3*b*; 4*a*, 4*b*, 5*a*, 5*b*, 6*a*, 6*b* for conductors (FIG. 1) which, as shown in FIG. 1, can be arranged on a plurality of levels one above the other in a stepped form on a plane at right angles to the arrangement direction, and which can be each conductively connected to one another in pairs via busbars 3*c*, 4*c*, 5*c*, 6*c*.

In this case, by way of example, the connections 3*a*, 3*b*, . . . can be in the form of tensioned spring connections, although a refinement using a different connection technique, for example a compression spring connection, insulation-displacement connection or screw connection, can likewise be feasible.

Figure 2:
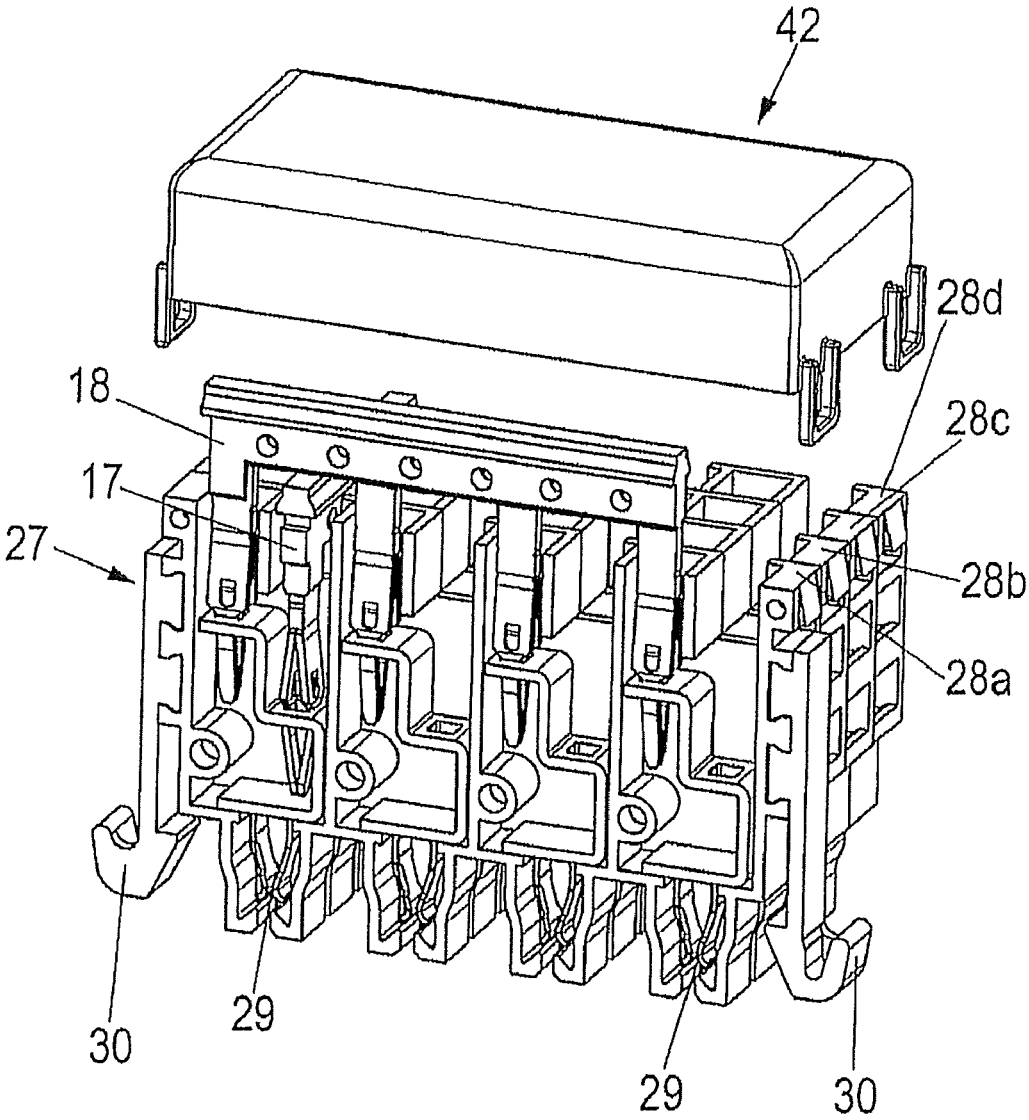
FIG. 2 shows a perspective view of a second, exemplary plug-like terminal block arrangement with two plugs in a contacted state.

It is also feasible for the connections 3*a*, 3*b*; . . . to be designed such that they can make direct contact with a plug connector (FIG. 2). The connections 3*a*, 3*b*; . . . and the busbars 3*c*, 4*c*, . . . can preferably be arranged one above the other on a plurality of levels 3, 4, 5, 6, in this case four levels.

In this case, the expression different connection levels can also be used to mean connections (3*a*, 3*b*; . . . ) which intrinsically lie on a level but are not necessarily the busbars (3*c*, 4*c*, . . . ) for connection of the connections (see FIG. 2).

The term busbar should not be understood in too narrow a sense. For the purposes of this application, it covers not only rails composed, for example, of metal, but for example, also conductor tracks or wire-like conductors and so forth.

As shown in FIG. 1, the terminal blocks can be designed to be latched onto a supporting rail 7, to which they can be firmly latched by an attachment foot 8.

Each of the exemplary terminal blocks 2*a*, 2*b*, . . . can, for example, be provided in its upper area, that is to say the area facing away from the supporting rail 7, with a plurality of plug-in slots 9, 10, 11, 12, 13, 14, 15, 16 for holding connectors 17, 18. As shown in FIG. 1, this area can be located directly centrally above the supporting rail 7.

In this case, two of the plug-in slots can, in each case, be combined to form a double plug-in slot, which can be achieved in a simple manner by two of the plug-in slots 9, 10 and 11, 12, etc. each being formed on step levels which differ from the supporting rail 7 or the lower face of the terminal blocks 2 and are a long distance apart, of an intrinsically stepped busbar 19, which for this purpose has plug-in openings 20, 21 on these different levels.

Each of the busbars 19 can be connected to one of the connection levels 3 to 6. This can be done, for example, by means of busbar pieces 23-26. Thus, by way of example, four stepped busbars 19*a*-*d* are provided as shown in FIG. 1, in which case each of the stepped busbars 19*a*-*d* is connected via one of the busbar pieces 23, 24, 25, 26, which can, for example, run at right angles to the supporting rail, to in each case one of the busbars 3*c*, 4*c*, 5*c*, 6*c* which are arranged on different levels.

By way of example, as shown in FIG. 1, the insertion openings 21 which are closer to the supporting rail 12 can be used to hold the first connectors 17 which extend "transversally" or "horizontally", in the form of cross-connectors, in the arrangement direction of the terminal blocks or in the main extent direction of the supporting rail 7.

The insertion openings 20 which are located further away from the supporting rail 7 can, in contrast, be used to hold further plug-in connectors 18, which can be aligned as "vertical connectors" at right angles to the arrangement direction of the terminal blocks and to the main extent direction of the supporting rail, and can be used to connect to one another different plug-in slots within a single terminal block and thus to connect individual ones or all of the busbars 3*c*, 4*c*, . . . or connection levels 3, 4, 5, 6 within each terminal block (referred to as "vertically").

The insertion openings 20, 21 for the connectors 17, 18 can accordingly be grouped like a matrix.

The stepped configuration of the busbars 19 for holding the connectors 17, 18 can make it possible in a simple manner to arrange in each case two of the connectors such that they effectively cross over one another. This allows cross-distribution of busbars and potentials within the terminal block arrangement on the one hand in the arrangement direction and on the other hand at right angles to the arrangement direction.

The connectors 17, 18 can, for example, be designed like combs, and each have a rear area 17*a*, 18*a* and plug-in areas 17*b*, 18*b*, which can, for example, preferably be disconnected, such that widely differing potential distribution systems can be achieved by knocking out plug-in areas 17*b*.

By way of example, a maximum of four exemplary terminal blocks 2*a*, 2*b*, . . . can be connected to one another in the arrangement direction by one connector 17 having four plug areas 17*b* in the arrangement direction X. If in each case one of the further connectors 18 is now still arranged in each of the four terminal blocks 2*a*, 2*b*, . . . , connecting the busbars 3*c*, 4*c*, . . . to one another within each of the exemplary terminal blocks 2*a*, 2*b*, 2*c*, 2*d*, a potential can be applied in a simple manner to a large number—in this case sixteen—connections 3*a*, 3*b*, 4*a*, . . . . The number of connections is an example. In addition, more or less than eight connections 3*a*, 3*b*; . . . and/or less than or more than four connection levels 3-6 may also be provided for each terminal block 2.

It is also feasible to provide further connectors on the upper face or in/on the side areas of the terminal blocks.

As an alternative to FIG. 1, FIG. 2 shows an exemplary plug-like connector attachment block 27, which in this case includes four top terminals 28*a*, 28*b*, . . . , which are combined to form the cross-connection block, which can be latched as an entity onto a terminal block arrangement having a corresponding recess and corresponding connections (the latter are not illustrated here). In this case, the busbars 19 can each be provided with plug-in areas 29 which, in this case by way of example, are like tulips in the direction of the terminal block (at the bottom in FIG. 2), and can be used to make contact with corresponding plug-in areas, for example, on a terminal block arrangement (not illustrated here).

The exemplary connector attachment block 27 has at least one latching hook 30 which can, for example, be plugged on or is integrally formed, for latching on a correspondingly designed terminal block.

The options for cross-distribution on the busbars 19 otherwise correspond to those in the exemplary embodiments shown in FIG. 2. For example, a cover 42 is used for dust protection.

Figure 3:
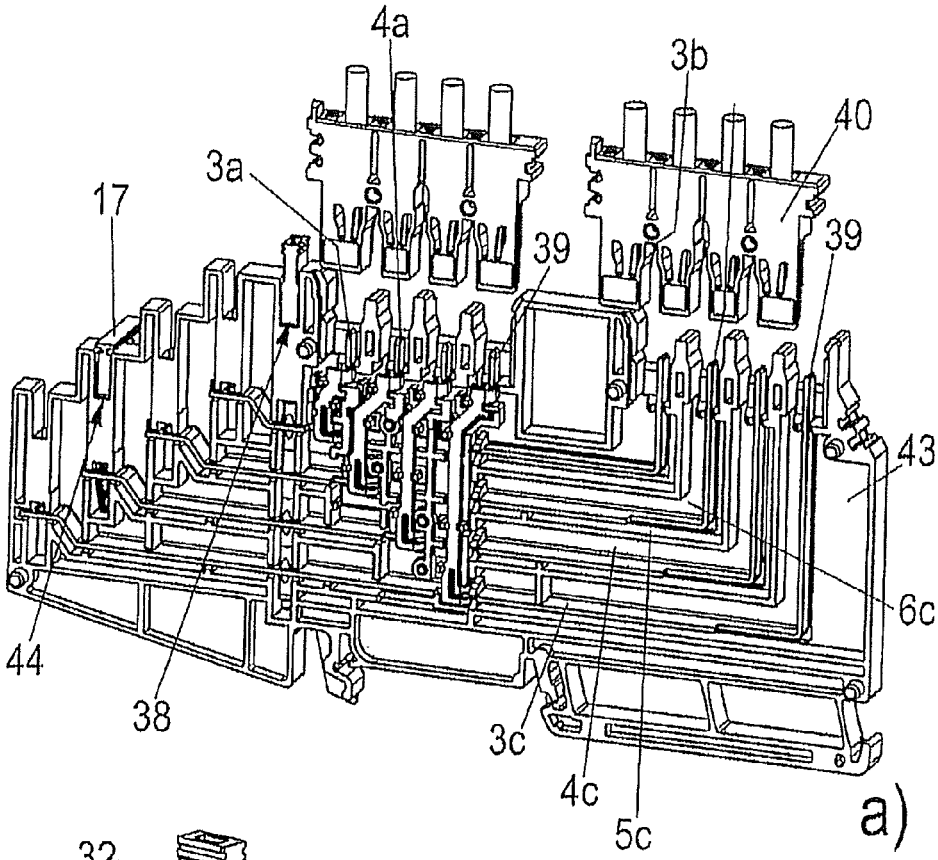
FIG. 3*a* shows a perspective view of a third exemplary terminal block for a terminal block arrangement with two plugs in the a not-yet contacted state.
FIG. 3*b* shows an exemplary connector for the arrangement shown in FIG. 3*a*.
Figure 3:
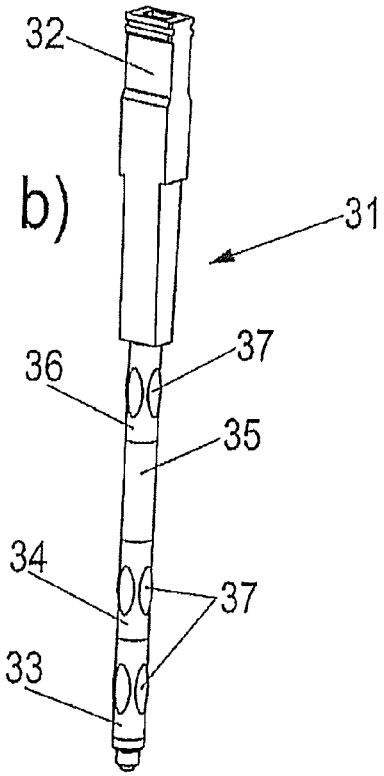

FIG. 3 illustrates an exemplary terminal block 43 which can be arranged in a row to form a terminal block arrangement and in which busbars 3*c*-6*c*, which are located one above the other, can be connected "vertically" via a type of configurable connector pin or plug 31, which can have a grip part 32 and pin sections 33-36 which can be fitted to the grip part 32. The pin sections 33-36 can each be designed to be either conductive or insulated on the external circumference in the area of a busbar.

As shown in FIG. 3, the exemplary lower two pin sections 33, 34 can be made conductive by means of one or more spring areas 37, the third pin section 35 can be insulating on the outside and can be conductive in its interior, and the upper pin section 36 can once again be designed to be conductive, by means of spring areas 37, on its external circumference. If the connector pin 31 which has been preconfigured in this way is inserted into an opening 38, which passes through all the connection levels 3, 4, 5, 6, in the insulating material housing, and is inserted in the busbars 3*c*, 4*c*, . . . , the outer spring areas 37 on the first, second and fourth connection levels respectively make contact with the busbars 3*c*, 4*c*, 6*c* located there, while in contrast they are not connected from underneath to the third connection level 5*c*.

The connections and busbars 3*c* to 6*c* can be connected to one another in a freely configurable form by an appropriate configuration of the connector pin 31, that is to say by a choice and combination of pin sections which are conductive and non-conductive on the external circumference. This measure may be combined, if desired, with further connectors, which extend in the arrangement direction of the supporting rail.

It is also possible to prefabricate a number of differently designed connector pins or to design them as pins which are not freely configurable, with conductive and non-conductive areas in the axial direction.

The connections 3*a*, 4*a* of the exemplary terminal block can in this case be otherwise designed in the same way as the pin 39 which can easily make contact with the plugs 40 individually or as a group.

Connectors 17 for cross-connection of the terminal blocks 43*a* in the arrangement direction can be plugged onto plug-in slots 44 in this case in the side area of the insulating housings. In the case of the exemplary terminal block arrangement shown in FIG. 3, this once again can result in a "horizontal" potential cross-distribution not only in the arrangement direction but also a "vertical" potential cross-distribution within each of the terminal blocks 43*a*, 43*b*, . . . . This once again makes it possible to achieve potential distribution in the arrangement direction over a plurality of terminal blocks as well as within each busbar, over the various levels of busbars.

Thus, it will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

LIST OF SYMBOLS

Terminal block arrangement 1
Terminal blocks 2*a*, 2*b*, . . .
Connections 3*a*, 3*b*; 4*a*, 4*b*, . . .
Busbars 3*c*, 4*c*, . . .
Levels 3, 4, 5, 6
Supporting rail 7

Attachment foot 8
Plug-in slots 9, 10, 11, 12, 13, 14, 15, 16
Connectors 17, 18
Rear areas 17*a*, 18*a*
Plug-in areas 17*b*, 18
Busbar 19
Plug-in openings 20, 21
Busbar pieces 22
Busbar pieces 23, 24, 25, 26
Connector pin or plug 31
Grip part 32
Pin sections 33, 34, 35, 36
Spring areas 37
Opening 38
Pins 39
Plug 40
Insulating body 41
Cover 42
Terminal block 43
Plug-in slots 44

What is claimed is:

1. A terminal block, comprising:

at least one connection for electrical conductors or plugs;

a plurality of busbars, which conductively connect the conductor connections or plug connections and are arranged on a plurality of different levels; and a configurable, plug-in cross-connector for conductive connection of at least two of the busbars, which are arranged on different levels, the cross-connector being a connector pin with conductive and non-conductive sections in an axial direction.

2. The terminal block as claimed in claim 1, wherein the connector pin comprises:

a grip section and pin sections which can be plugged together, the pin sections including portions which are conductive on the external circumference.

3. The terminal block as claimed in claim 1, wherein the connector pin comprises:

a grip section and pin sections which can be plugged together, the pin sections including portions which are non-conductive on the external circumference.

* * * * *